US006283198B1

(12) United States Patent
Medovar

(10) Patent No.: US 6,283,198 B1
(45) Date of Patent: Sep. 4, 2001

(54) ELECTROSLAG FACING PROCESS

(75) Inventor: Boris I. Medovar, Kiev (UA)

(73) Assignee: Zakrytoe Aktsionernoe Obschestvo "Elmet-Rol-Guppa Medovara", Kiev (UA)

( * ) Notice: Subject to any disclaimer, the term of this patent is extended or adjusted under 35 U.S.C. 154(b) by 0 days.

(21) Appl. No.: 09/381,341

(22) PCT Filed: Jan. 19, 1998

(86) PCT No.: PCT/UA98/00003

§ 371 Date: Sep. 20, 1999

§ 102(e) Date: Sep. 20, 1999

(87) PCT Pub. No.: WO98/41343

PCT Pub. Date: Sep. 24, 1998

(30) Foreign Application Priority Data

Mar. 18, 1997 (UA) ..... 97031185

(51) Int. Cl.[7] ..... B22D 27/02
(52) U.S. Cl. ..... 164/496; 164/497
(58) Field of Search ..... 164/495, 496, 164/497, 470, 509, 515, 514

(56) References Cited

U.S. PATENT DOCUMENTS

| | | | | |
|---|---|---|---|---|
| 3,818,973 | * | 6/1974 | Paton et al. | 164/252 |
| 4,055,215 | * | 10/1977 | Ramacciotti et al. | 164/252 |
| 4,305,451 | * | 12/1981 | Ksendzyk | 164/515 |
| 4,418,741 | * | 12/1983 | Bondarenko et al. | 164/454 |
| 5,146,976 | | 9/1992 | Bramblett . | |
| 5,419,973 | | 5/1995 | Hashimoto et al. . | |

FOREIGN PATENT DOCUMENTS

| | | |
|---|---|---|
| 57062839 | 4/1982 | (JP) . |
| 60063330 | 5/1985 | (JP) . |
| 7155932 | 5/1995 | (JP) . |
| 2069614 | 11/1996 | (RU) . |
| 286720 | 8/1983 | (SU) . |
| WO 81/01812 | 7/1981 | (WO) . |
| WO 94/22619 | 10/1994 | (WO) . |

OTHER PUBLICATIONS

B.E. Patona, "Elektroshlakovaya Svarka I Naplavka", Moscow "Mashinostroenie" 1980, pp. 281–284.
Database WPI, Section CH, Week 199006, Dewent Publications Ltd., London, GB. Class M22, AN 1990–043453 XP002161592.

* cited by examiner

*Primary Examiner*—Tom Dunn
*Assistant Examiner*—Len Tran
(74) *Attorney, Agent, or Firm*—Young & Thompson

(57) ABSTRACT

The disclosed process consists in filling the gap between a billet and the wall of a sectional mould with a molten slag in at least two stages. When the first portion is poured in, the gaps between the sections of the mould are filled. Once the slag in the gaps is solidified completely, voltage is supplied and the second and next portions of the slag are added. The creation of an electromagnetic field inside the mould takes place following the starting of the cladding process. The liquid metal is then added for the cladding process, which is carried out by means of the stable rotation of the slag and metal. The process can be carried out with varying levels of slag inside the current-carrying part of the mould. The billet can be preheated at the short-circuiting conditions prior to the cladding process.

6 Claims, 2 Drawing Sheets

ELECTROSLAG FACING PROCESS

FIELD OF THE INVENTION

The invention relates to the field of metallurgy, and more specifically to the method of an electroslag cladding of elongated round-section parts mainly and can be used, in particular, in production and repair of all kinds of mill rolls, rollers of machines for a continuous casting of billets, roller tables, rollers of heating furnaces, etc.

PRIOR ART

The application of different methods of cladding for these purposes, including electroslag cladding, is widely known, allowing deposition on the above-mentioned products of a working layer made from metal or intermetallics of the chemical composition similar or different to that of the basic product.

This application will not deal with the known methods of cladding using solid electrodes in the form of wire, strip, tube, etc. as a material for cladding.

The most up-to-date method of cladding of the above-mentioned products is a cladding with a liquid metal which can drastically reduce the cost of the process and products and use the cladding materials of almost any chemical compositions, the production of which in the form of solid electrodes is very expensive or impossible in separate cases.

For example, patent of UK No. 1469113 of Mar. 30, 1977 describes the method of electroslag cladding using the liquid metal. However, the use of a conventional, non-current carrying mould could not realize this process on an industrial scale, as the device for its realization was too complicated and expensive.

In publication "Development of High-Performance Roll by Continuous Pouring Process for Cladding" (ISIJ International, Vol. 32 (1992), No. 11, pp. 1202–1210) a method of cladding with a liquid metal is described which is similar in principle to the process of a vertical continuous casting of steel. This method is implemented in industry, however, it does not realize the fusion of the metal to be clad and billet to be clad, but it brazes them. This limits the feasibility of combination of different metals: for example, this method can be used for coating steel rolls from low-alloyed steels with a high-speed steel. However, his method cannot be applied for cast iron rolls. In addition, the above-mentioned method is performed within very limited ranges of technological parameters, thus often leading to the violation of continuity of the brazed joint of the roll and metal being clad.

The U.S. Pat. No. 4,305,451 of Feb. 15, 1981 describes the method of electroslag cladding in a sectional current-carrying mould, which has no majority of the above-mentioned drawbacks, however, it describes mainly the solid lumpy filler materials (shot, powder, chip, etc.) as a material for cladding, thus limiting the application of this process only for the cast iron rolls, which are clad also with the same cast iron.

Method, described in French patent No. 93-03925 of Apr. 02, 1993, MPK B22D 19/16,11/00, is most close by combination of features and, therefore, it was taken, as a closest prior art. In this method the cladding of elongated billets (mainly of round section) is performed using a sectional mould with a current-carrying part and a non-current carrying forming part and includes a mounting of billet to be clad into a said mould, a pouring a liquid metal and a molten slag to the gap between the billet to be clad and a mould wall for cladding, a passing of the electric current and proceeding of cladding process with a simultaneous withdrawal of the clad billet.

However, this method does not allow the process of cladding to be realized with a formation of a reliable joining of the material being clad and a billet due to the following reasons The method is performed with vertical oscillations of the a current-carrying mould, similar to the continuous casting. However, all the known electroconductive slags for the electroslag process possess, as to their physical and mechanical properties, a low viscosity within the range of temperatures, close to the temperature of their solidification and being an operation range of temperatures for the electroslag process with a withdrawal of billets. The above-said circumstance leads inevitably to destroying a thin slag crust in the process of withdrawal of the billet, which consequently leads inevitably to a spillage of the metal being clad. The method is performed with a pouring of a cladding metal into a current-carrying (heated) part of the mould and subsequent pouring of an electroconductive slag. At such sequence of pouring operations, i.e. first metal, then slag, there exists a risk of a short-circuiting between the current-carrying upper part of the mould and the billet during cladding.

The above-mentioned circumstances are the essential drawbacks of the present method which complicate it unjustifiably and almost reject its realization.

SUMMARY OF THE INVENTION

The invention proceeds from the task of improvement of the known method of electroslag cladding by changing the sequence of operations of pouring the molten slag and liquid metal, fulfilment of operations of pouring of the molten slag, at least, in two stages, conductance of operation of pouring liquid metal after the operation of setting-up the mould for an electrical condition of starting the process of electroslag cladding, and an automatic control of the liquid metal level in the mould to realize the simple and reliable method of cladding at almost unlimited combination of chemical compositions of the billet to be clad and metal to be clad.

The above task is solved by a proposing a method of electroslag cladding of elongated round-section billets mainly using a sectional mould with a current-carrying part and a non-current carrying forming part, including a mounting of billet to be clad into the above-said mould, the pouring of a molten slag, being electroconductive in a molten state and non-electroconductive in a solid state, and a liquid metal for cladding into the gap between the billet to be clad and the mould wall, a passing of electrical current through a melt and conductance of the process of the electroslag cladding with a simultaneous with-drawal of the clad billet. In accordance with the invention the molten slag is poured into a gap between the billet to be clad and the mould wall in, at least, two stages, prior to pouring the liquid metal for cladding, with the first portion of the slag being poured in the amount sufficient for filling all the air gaps between the sections of the mould with a subsequent holding up to a complete solidification in the above-said gaps, and then the electrical voltage is supplied to a current-carrying part of the mould and billet to be clad, and the second and next portions of the molten slag are poured, the mould is set for electrical conditions of starting the process of the electroslag cladding and a force magnetic field is created in the mould, after which the liquid metal is poured for cladding and the electroslag cladding process is realized at a stable rotation of the molten slag and liquid metal, being created in the mould by an action of a force magnetic field.

In the of the present invention method, first in the routine of the electroslag cladding, a reliable electrical isolation of elements of the sectional mould is made as if automatically with a non-electroconductive solid-state slag. When pouring the first portion of the molten slag it fills all existing air gaps in the mould, between sections in particular, solidifies in these gaps and guarantees the complete isolation. Only after making such an isolation the electroslag process is proceeding,the stable conditions for the start of the cladding process are created and the accident-free operation of the mould is guaranteed. The stable rotation of the molten flux and liquid metal which is set in the mould under the action of a force electromagnetic field, provides an effective averaging of the pool temperature, intensifies the processes of refining, contributes to averaging the chemical composition and refining the structure of the layer being clad and provides the intensive cleaning of surface being clad with a slag melt.

It is rational during the process proceeding to pour the liquid metal for cladding in a volume which is less than that of the non-current carrying forming part of the mould.

This eliminates the feasibility of short-circuiting between the part to be clad and a current-carrying section of the mould through a liquid metal whose level in a non-current carrying forming part of the mould is increased at the mould walls at a unidirectional stable rotation of the liquid metal which is set under the action of the electromagnetic field.

It is preferable to pour the liquid metal for cladding in portions, and to determine the volume of each portion with the help of a sensor of the level of liquid metal which is leaded into a non-current carrying forming part of the mould.

Such operation can control precisely the volume of the molten pool in the mould and to maintain, respectively, a preset cladding condition, and also control constantly the metal supply to the mould during the whole process of cladding due to a feed back between a level sensor and a pouring device.

It is also desirable to perform the electroslag cladding at a varying level of slag in a current-carrying part of the mould.

The change in a slag pool level allows the value of heat input into a billet to be changed and a uniform melting of the billet along its height to be provided.

It is also rational to supply the electrical voltage to the billet to be clad in, at least, two places, i.e. in a current-carrying section of the mould and beyond the mould.

This simplifies the system of current supply to the billet to be clad and takes away almost any limitations for the type of billet to be clad.

It is preferable to preheat the billet to be clad before cladding using the short-circuiting conditions.

This operation allows the billet preheating to be realized directly in the mould, thus eliminating the use of special thermal means, reducing the time which is required for melting the external layer of the billet to be clad at the expense of the heat, generated in a slag pool, and also noticeable decreasing the total time of cladding and energy consumption per ton of the metal being clad.

A DETAILED DESCRIPTION OF THE INVENTION

Figure 1:
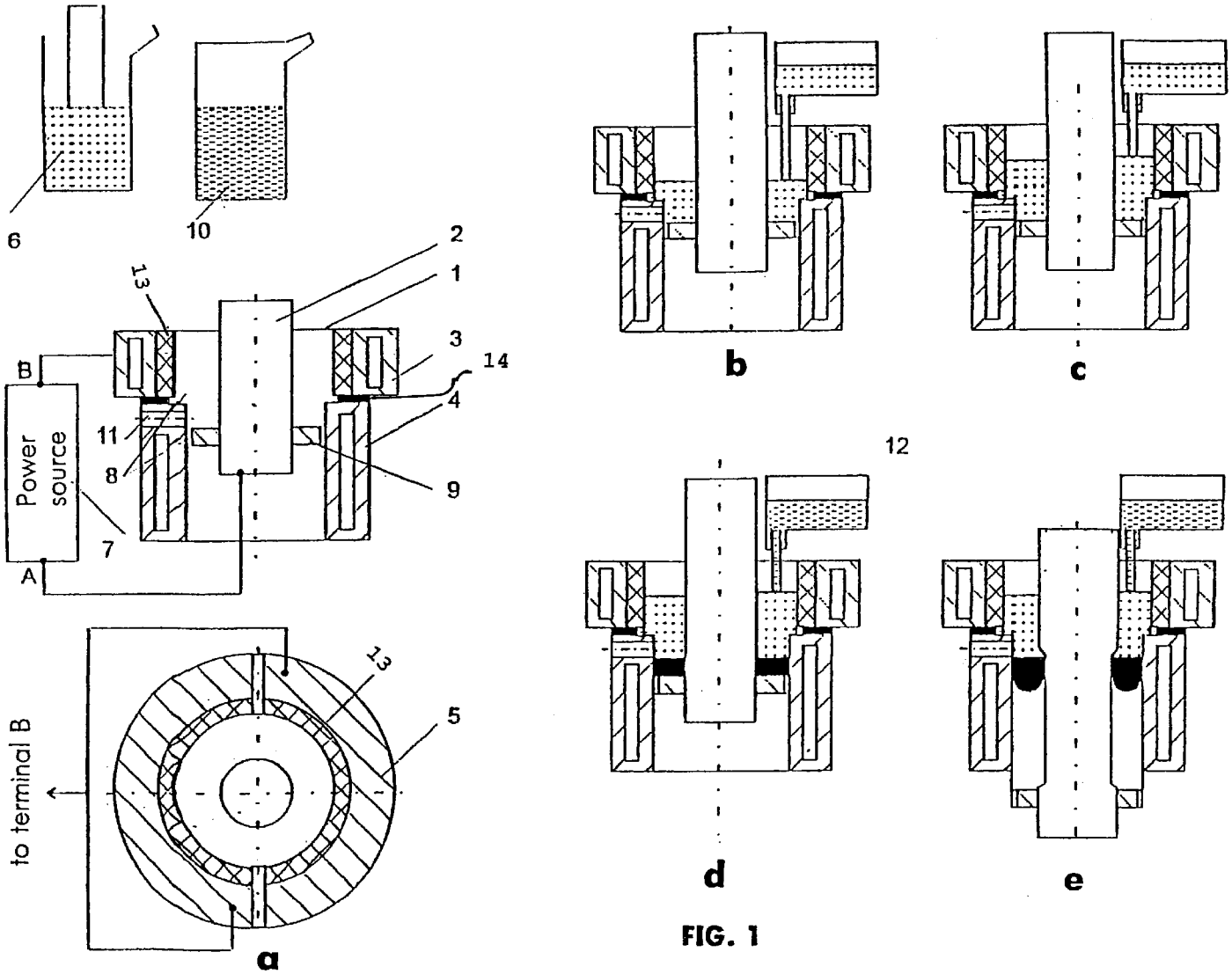
FIG. 1 shows schematically the arrangement of parts to be clad in a sectional mould, their connection to a power source and sequence of operations of pouring the molten slag and liquid metal to the mould for cladding.

The principle of the of the present invention method is reduced to the following.

A billet to be clad 2 is mounted into a current-carrying sectional mould 1 (FIG. 1,*a*) and a longitudinal billet axis is brought in line with a longitudinal axis of the mould. The mould is divided in sections along the height into a current-carrying part 3 and non-current carrying forming part 4. The current-carrying upper part of the mould is also divided, as a minimum, into two sections 5. Such dividing into sections provides a uniformity in current and heat distribution. The electro-insulator (14) is provided between the divided sections 5. For protective from spark erosion, the two sections 5 have an electrically conductive lining 13.

Figure 2:
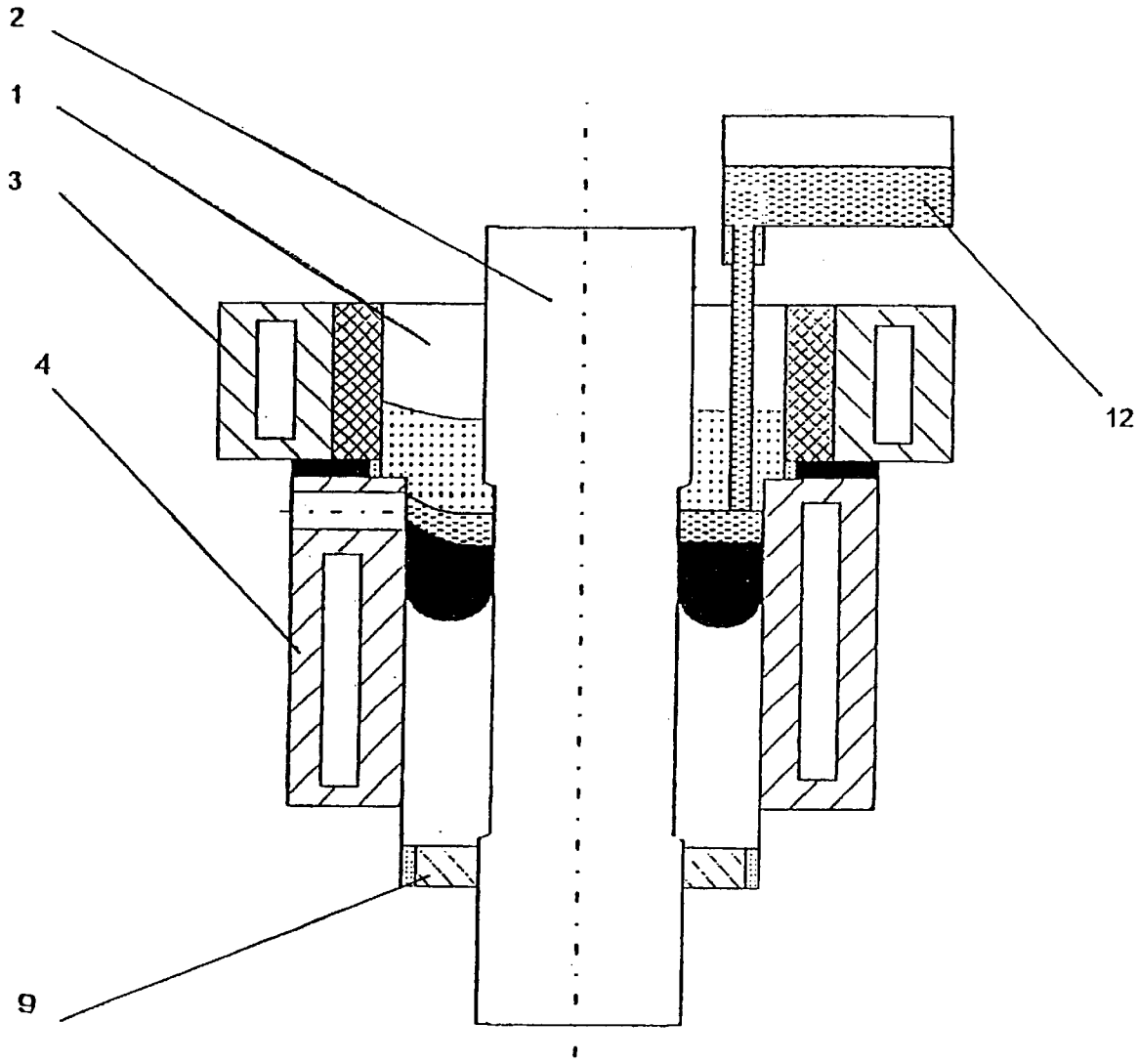
FIG. 2 shows the scheme (at magnification) of distribution of slag and metal in the mould at a steady condition of the electroslag cladding process with a simultaneous withdrawal of the clad billet.

Slag is melted in a flux melting furnace 6, for example $\frac{1}{3}CaF_2$-$\frac{1}{3}CaO$-$\frac{1}{3}Al_2O_3$, and poured into a mould 1 up to the level shown in FIG. 1,*b*. Power source 7 is now switched off. Instantaneously, the highly fluid slag fills all the air gaps 8 between the mould sections including a bottom plate-primer 9. Then, the power source 7 is switched on and the slag is poured by portions or continuously up to a definite level, shown in FIG. 1,*c*, into a current-carrying section of the mould, i.e. the electrical circuit is closed and the electroslag process is commenced. After setting up the preset electrical conditions the cladding process starts portion and/or continuous pouring of the liquid metal for cladding, which is melted in a separate unit 10 or in the same flux melting furnace 6 is poured into a gap between the billet to be clad and the mould wall up to the level, indicated in FIG. 1,*d*,and the clad billet starts to be withdrawn from the mould. With reference to FIG. 2, as the billet is withdrawn the metal for cladding has a liquid portion 12', a solid-liquid portion 12", and a solidified portion 12'". The solidified portion of the slag is shown at 8'.

Sectioning of the current-carrying part of the mould, i.e. the series connection at least of two isolated segments provides not only the uniform current and heat distribution in slag and metal pools, but also energizes their intensive rotation, up to hundreds of rotations per minute. Thus, as shown in FIG. 2, the surface of the slag pool and the interface of metal and slag pool do not have a perfect flat shape such as shown in the right part of FIG. 2, but have a shape which is close to a parabolic of rotation such as shown in the left part of FIG. 2. It is precisely this fact that explains the risk of short-circuiting the current-carrying and non-current carrying forming sections and their possible damage during the pouring of the liquid metal. To avoid this the pouring of metal is used in a preset lower amount than the volume of the forming section of the mould, limited by a billet to be clad, front of solidification of the clad metal and a horizontal plane which separates the current-carrying and non-current-carrying sections of the mould.

In case of using only the portion supply of filler metal into the mould, the volume of the supplied portions are determined with the help of a special sensor of level 11, mounted in a non-current carrying forming section of the mould and due to a flexible feed back between the sensor of level and a pouring device 12 the process of a portion metal supply to the mould over the whole cladding process is controlled.

Unlike the conventional electroslag process with a constant slag level in the mould, including a current-carrying mould, a proposing method uses a gradual change in the level of the slag pool in a current-carrying part of the mould to provide a uniform melting of the billet along its height during the process of cladding. Due to changes in ratios between current and voltage, this permits to react to changes in heat parameters of the process in the course of cladding.

The current to the billet to be clad is supplied, depending on definite technological conditions, either to the upper or lower part of the billet, or to the both points. When necessary to use the preliminary preheating of the billet before cladding an auxiliary (for example, third) current conductor can be used.

To reduce time necessary for melting the external layer of the billet to be clad at the expense of the heat, generated in the slag pool, the billet to be clad, mounted in the mould, is preheated before cladding by a short-circuiting current. This operation allows the total time of cladding to be drastically reduced and the consumption of the specific electrical energy to be decreased.

EXAMPLE OF THE INVENTION REALIZATION

In a real case of cladding using the method of the present invention the concrete data are as follows:

Inner diameter of a non-current carrying forming part of the mould is 620 mm, similar to he inner diameter of a current-carrying section, composed of two parts, connected in series to common terminal of the furnace transformer of an industrial frequency and 2500 kW capacty. Height of the forming part is 350 mm, while that of the current-carrying part is 200 mm. Axle to be clad, made of low-alloyed steel of 4140 type, ASTM, has a 500 mm diameter and 2500 mm total length. 1800 mm are clad with steel of the D2 type of the same standard. A bottom plate-primer is mounted by 15 mm lower than the upper cut of the non-current carrying forming section and 21.8–22 kg of slag are poured up to level of 20 mm higher of the lower cut of the current-carrying sections. The slag is stayed till its complete solidification in the gaps of bottom plate-mould wall, non-current carrying section-current-carrying section and in gaps between current-carrying semi-sections. After the slag solidification in the mentioned gaps the electrical supply of the installation is connected and a next portion of the molten slag is poured till the level of 50 mm higher than the lower cut of current-carrying sections. Power in the mould is set within 580–600 kW. After setting the preset electrical conditions the portion pouring of the liquid metal (the portion is 4.5–5.0 kg) is performed into a gap between the billet to be clad and the mould wall. The withdrawal rate is kept at the level of 6–8 mm/min. The slag level in the mould during cladding is decreased smoothly from 50 mm to 20 mm higher of the lower cut of the current-carrying section. Each next portion of the cladding metal is supplied by a signal from the level sensor, which indicates the decrease in level of the liquid metal in the forming section of the mould below the set level of the sensor.

Industrial application

The invention can be used in metallurgy, here the highest efficiency can be obtained in production and repair of elongated round-section parts, such as mill rolls, rollers of machines of continuous casting of billets, roller tables of rolling mills, rollers of heating furnaces,etc.

What is claimed is:

1. A method of electroslag cladding an elongated round-section billet with a sectioned mold having a current-carrying part and non-current carrying forming part, comprising the steps of:

mounting the billet in the mold;

pouring molten slag into a gap between the billet and the mold in plural stages, the plural stages including pouring a first portion of the molten slag into the gap between a bottom plate primer and the non-current carrying forming part to a first level to fill an air gap between sections of the mold, allowing the slag to solidify in the air gap, providing electrical power to the current-carrying part of the mold and to the billet, and pouring a further portion of the molten slag into the gap between the bottom of the current carrying part and the top of the non-current carrying part to a second level higher than the first level;

setting electrical conditions for electroslag cladding and creating an electromagnetic field in the mold;

pouring a liquid cladding metal into the gap between the billet and the mold;

rotating the molten slag and the liquid cladding metal with the electromagnetic field; and withdrawing the billet from the mold while electroslag cladding the billet with the cladding metal.

2. The method of claim 1, wherein an amount of the cladding liquid metal that is poured does not fill the non-current carrying part.

3. The method of claim 1, wherein the cladding liquid metal is poured in portions, each portion's volume being determined with a sensor for sensing a cladding liquid metal level in the non-current carrying part.

4. The method of claim 1, including the step of varying a level of the slag in the current-carrying part.

5. The method of claim 1, wherein an electrical voltage is supplied to the billet at two places, one in the current-carrying part and one at a portion of the billet emerging from the mold after having been clad.

6. The method of claim 1, further comprising the step of preheating the billet.

* * * * *